US007856962B2

(12) United States Patent
Harvey et al.

(10) Patent No.: US 7,856,962 B2
(45) Date of Patent: Dec. 28, 2010

(54) FUEL SYSTEM FOR A DIRECT INJECTION INTERNAL COMBUSTION ENGINE

(75) Inventors: William T. Harvey, Brighton, MI (US); Steven J. Miller, Livonia, MI (US); Hiroaki Saeki, West Bloomfield, MI (US)

(73) Assignee: Hitachi Automotive Products (USA), Inc., Harrodsburg, KY (US)

( * ) Notice: Subject to any disclaimer, the term of this patent is extended or adjusted under 35 U.S.C. 154(b) by 31 days.

(21) Appl. No.: 12/476,573

(22) Filed: Jun. 2, 2009

(65) Prior Publication Data

US 2010/0300406 A1 Dec. 2, 2010

(51) Int. Cl.
*F02M 55/02* (2006.01)

(52) U.S. Cl. ..... 123/470

(58) Field of Classification Search ..... 123/456, 123/468, 469, 470

See application file for complete search history.

(56) References Cited

U.S. PATENT DOCUMENTS 5,035,224 A * 7/1991 Hornby et al. ..... 123/470
5,074,269 A * 12/1991 Herbon et al. ..... 123/470
5,146,896 A * 9/1992 Imoehl et al. ..... 123/470
5,390,638 A * 2/1995 Hornby et al. ..... 123/456
5,803,052 A * 9/1998 Lorraine et al. ..... 123/470
5,970,953 A * 10/1999 Lorraine et al. ..... 123/470
6,053,149 A * 4/2000 Lorraine ..... 123/470
6,668,803 B1 * 12/2003 McClean et al. ..... 123/470
6,748,925 B1 * 6/2004 De Vulpillieres et al. .... 123/470
7,467,618 B2 * 12/2008 Zdroik et al. ..... 123/470
7,556,022 B1 * 7/2009 Doherty et al. ..... 123/470
2005/0161025 A1 * 7/2005 Braun et al. ..... 123/470

* cited by examiner

*Primary Examiner*—Thomas N Moulis
(74) *Attorney, Agent, or Firm*—Gifford, Krass, Sprinkle, Anderson & Citkowski, P.C.

(57) ABSTRACT

A fuel system for a direct injection internal combustion engine having a fuel rail and at least one annular cup secured to the fuel rail so that fuel from the fuel rail flows into the cup. A direct injection fuel injector has a portion axially insertable into the fuel cup to a connected position. A recessed channel on the fuel injector registers with a slot in the annular cup when in the connected position so that a U-shaped clip insertable into the cup slots and the fuel injector channels secures the fuel injector and cup together against axial movement.

9 Claims, 2 Drawing Sheets

FUEL SYSTEM FOR A DIRECT INJECTION INTERNAL COMBUSTION ENGINE

BACKGROUND OF THE INVENTION

I. Field of the Invention

The present invention relates generally to direct injection internal combustion engines and, more particularly, to a system for attaching the fuel injectors to the fuel rail.

II. Description of Material Art

Direct injection internal combustion engines are enjoying increased popularity due to their fuel efficiency and low emissions. In such direct injection engines, the fuel injector has one end open directly to the internal combustion chamber so that fuel from the fuel injector injects directly into the internal combustion chamber rather than upstream from the intake valves as in the previously known multipoint fuel injector engines.

In order to ensure the proper introduction of fuel into the engine combustion chamber, the fuel is provided to the fuel injector under very high pressures. Furthermore, it is necessary to lock the fuel injector to the fuel rail against movement despite these high fuel pressures.

In one type of previously known mount for the fuel injector, a fuel cup was attached at one end to the fuel rail and open at its other end. The fuel injector was inserted into the open end of the fuel cup and then secured to the fuel cup against axial movement by a two piece clip arrangement. This two piece clip arrangement, however, suffered several disadvantages.

One disadvantage of the previously known two clip means for attaching the fuel injector to the cup is that the actual attachment of the two piece clip for each injector was time consuming and somewhat difficult to achieve. This, in turn, increased the labor cost for assembling the fuel injectors to the fuel rail.

A still further disadvantage of this previously known two clip arrangement for securing the fuel injector to the fuel cup was that the actual two piece clip assembly was relatively expensive to manufacture. This, in turn, increased the overall cost of the fuel rail assembly with the attached fuel injectors.

SUMMARY OF THE PRESENT INVENTION

The present invention provides a fuel system for a direct injection engine which overcomes the above-mentioned disadvantages of the previously known engines.

In brief the fuel system of the present invention comprises a fuel rail having an interior chamber. A fuel pump supplies pressurized fuel to the interior chamber of the fuel rail and the fuel rail, in turn, provides pressurized fuel to each fuel injector.

An annular cup is provided for each fuel injector. Each annular cup has one end secured to the fuel rail while its other end is open. The first end of the cup, furthermore, fluidly communicates with the interior chamber of the fuel rail.

A direct injection fuel injector is associated with each cup on the fuel rail. Each fuel injector includes a portion that is axially insertable into the open end of the cup and axially slidable to a connected position. The direct injection fuel injector also includes radially inwardly recessed channels on opposed sides of the injector portion that are inserted into the cup. These recessed channels register with through slots formed through the cup when the fuel injector is properly positioned at its connected position.

When the fuel injector is positioned at its connected position, a U-shaped clip is inserted into the cup slots and the fuel injector channels. In doing so, the U-shaped clip locks the fuel injector and cup together against axial movement. Furthermore, the clip preferably compressibly engages the fuel injector in order to lock the clip and fuel injector together.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
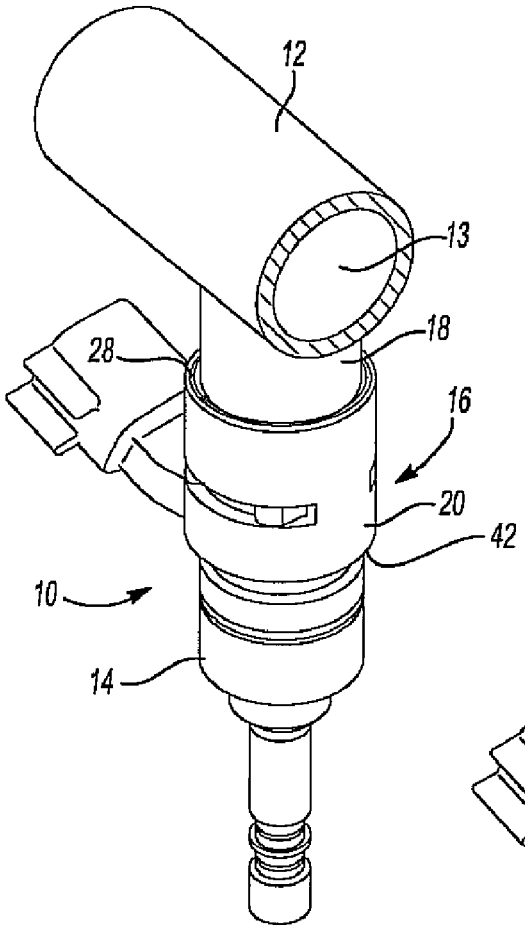
FIG. 1 is an elevational view illustrating a preferred embodiment of the invention.

With reference first to FIG. 1, a fuel system 10 for a direct injection internal combustion engine is shown. The fuel system 10 includes a fuel rail 12 having an interior chamber 13 that is supplied by a pump with pressurized fuel. Fuel from the fuel rail 12, in turn, is supplied under pressure to each fuel injector 14 (only one shown).

Figure 2:
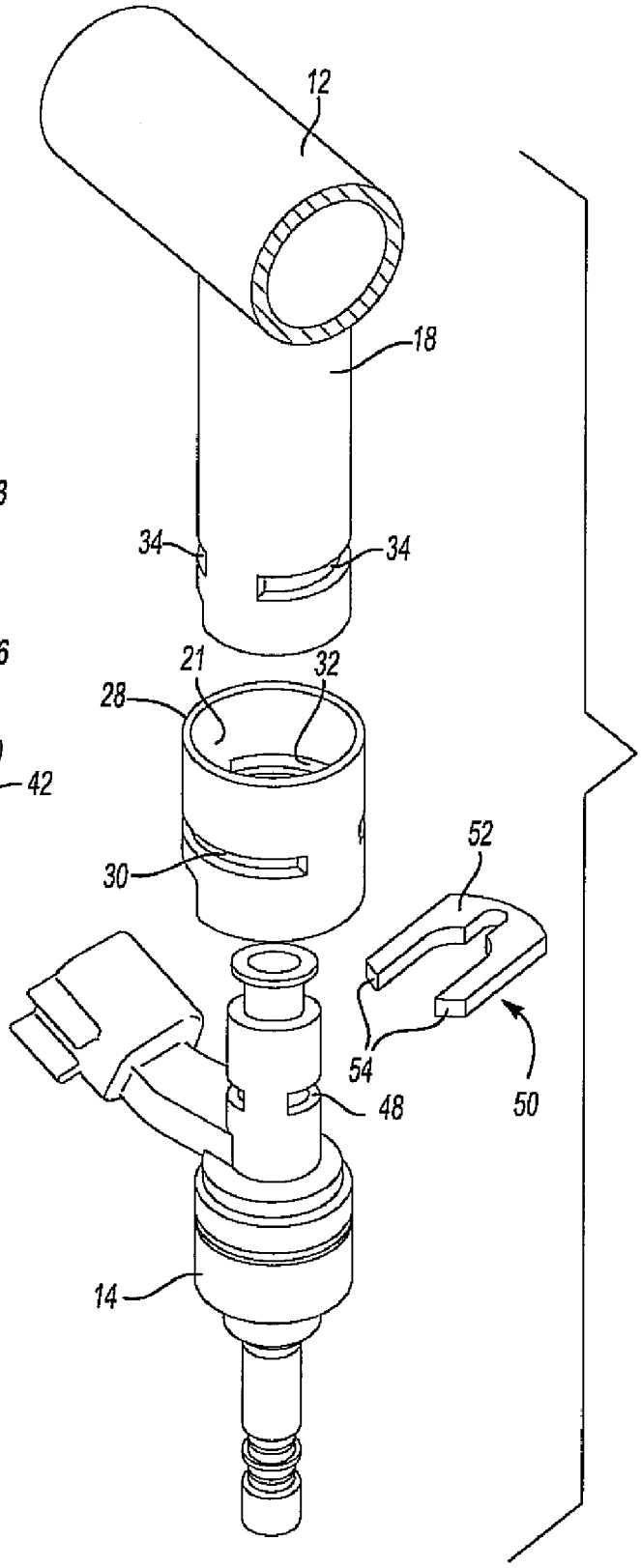
FIG. 2 is an exploded elevational view thereof.
Figure 3:
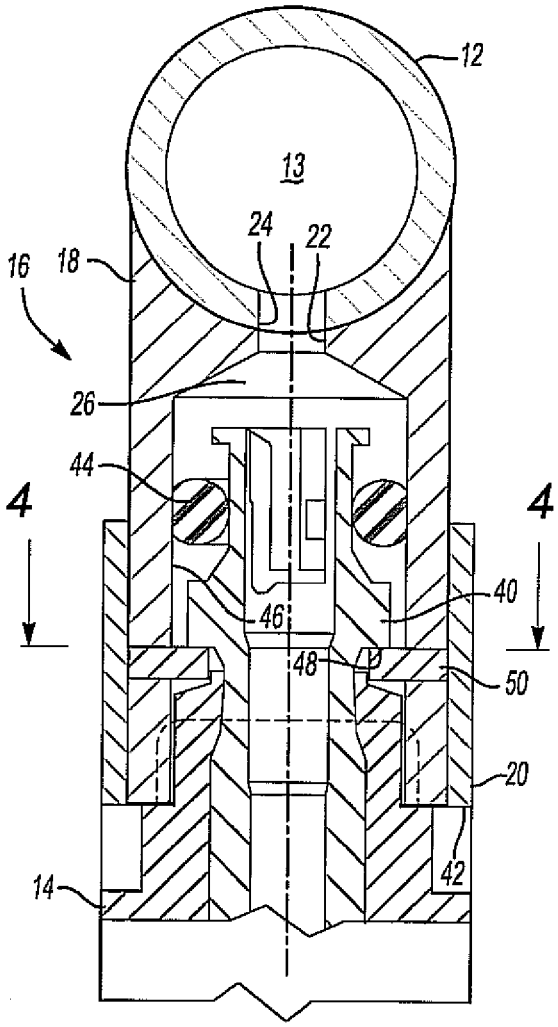
FIG. 3 is a fragmentary longitudinal sectional view thereof.

With reference now particularly to FIGS. 1-3, a cup 16 having upper portion 18 and a lower portion 20 is connected to the fuel rail 12 for each fuel injector 14. The cup 16 may be directly attached to the fuel rail 12 as shown or, alternatively, connected to the fuel rail by a conduit. A fluid passageway 22 through the upper portion 18 of the cup 16 fluidly connects a port 24 (FIG. 3) in the fuel rail 12 to an interior chamber 26 in the cup 16.

The lower portion 20 of the cup 16 includes a tubular and cylindrical recess 21 and has a first end 28 which is dimensioned to be slid over the upper portion 18 of the cup 16. The lower portion 20 is then fixedly secured to the upper cup portion 18 in any conventional fashion, such as by brazing, welding or the like.

Figure 4:
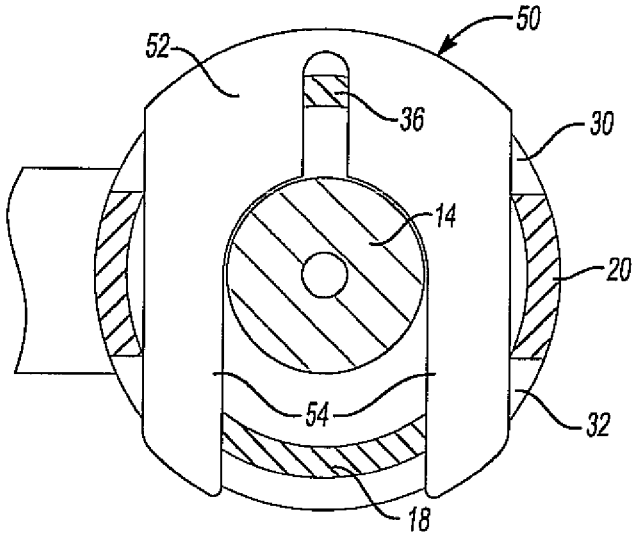
FIG. 4 is a cross sectional view taken along line 4-4 in FIG. 3 and enlarged for clarity.

With reference to FIGS. 2 and 4, the lower cup portion 20 is of a one piece construction and preferably made of metal. Additionally, the lower cup portion 20 includes two slots 30 and 32 (FIG. 2) that are formed on opposite sides of the lower cup portion 20. These slots 30 and 32 are axially aligned with but angularly offset by 90 degrees from two diametrically opposed slots 34 in the upper cup portion 18. These slots are separated from each other at one end by section 36 (FIG. 4).

With reference now to FIG. 3, the fuel injector 14 includes an upper portion 40 which is dimensioned to be slidably received within the cup chamber 26. Preferably, one or more seals 44 are disposed around the upper portion 40 of the fuel injector 14. These seals 44 compress between an outer surface of the fuel injector upper portion 40 and an interior surface 46 of the cup 16 to fluidly seal the fuel injector 14 and cup 16 together.

As best shown in FIGS. 2 and 3, the upper portion 40 of the fuel injector 14 also includes radially inwardly recessed channels 48 on diametrically opposed sides of the fuel injector upper portion 40. Alternatively, however, the channels 48 may comprise a single continuous channel 48 extending continuously circumferentially around the upper portion 40 of the fuel injector 14.

In order to assemble the fuel injector 14 to the fuel rail 12, the upper portion 40 of the fuel injector 14 is slid into the lower open end 42 of its associated cup 16 and into the cup chamber 26 to an operative or connected position as shown in FIG. 3. In this position, the fuel injector channel 48 registers with the slots 30, 32 and 34 formed in the cup 16.

With reference to FIGS. 3 and 4, with the fuel injector 14 in its connected position, a U-shaped clip 50 having a base 52 and two spaced apart side legs 54 is inserted into the cup slots 30, 32 and 34. The clip 50, furthermore, is dimensioned so that, with the clip 50 fully inserted, a portion of the clip side legs 54 is positioned within each slot 30, 32 and 34 as well as the channel 48 on the fuel injector 14. In doing so, the clip 50 locks the cup 16 and fuel injector 14 against axial movement relative to each other.

As best shown in FIG. 4, a notch 56 is formed in the base 52 of the clip 50. This notch 56 is dimensioned to slidably receive the section 36 between the slots 30, 32 and 34. Thus, with the connector 34 positioned in the notch 56, proper positioning of the clip 50 is ensured.

The clip 50, furthermore, is dimensioned to compressibly engage the fuel injector 14 once the clip 50 is fully inserted into the cup and fuel injector.

Figure 5:
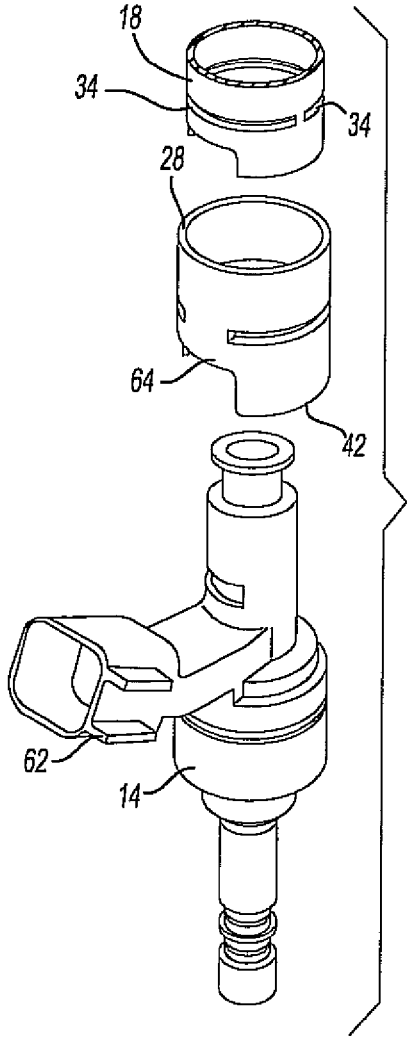
FIG. 5 is side view thereof.

With reference now to FIG. 5, a connector 62 extends laterally outwardly from a midpoint on the fuel injector 14. This connector 62 registers with a notch 64 formed in the open end 42 of the cup 16. Thus, when the fuel injector 14 is moved to its connected position, the base of the connector 62 nests within the notch 64. Consequently, the notch 64 and connector 62 automatically angularly align the fuel injector 14 with the cup 16 and thus with the fuel system 10.

From the foregoing, it can be seen that the present invention provides a simple and yet highly effective fuel system for a direct injection internal combustion engine in which the fuel injectors are secured to the fuel rail by a simple clip. The material cost for the clip 50 as well as the labor cost for assembling the fuel injector 14 to the cup 16 are minimized thus reducing the overall cost of the fuel system 10.

Having described our invention, however, many modifications thereto will become apparent to those skilled in the art to which it pertains without deviation from the spirit of the invention as defined by the scope of the appended claims.

We claim:

1. A fuel system for a direct injection internal combustion engine comprising:

a fuel rail having an interior chamber, an annular cup having one end connected to said fuel rail and open at a second end, said first end of said cup being fluidly connected to said fuel rail interior chamber, said cup having a first portion and a second portion, said first portion of said cup having a pair of diametrically opposed slots and said second portion of said cup having a pair of diametrically opposed slots, said slots in said first portion being axially aligned but offset by 90 degrees from said slots in said second portion, a direct injection fuel injector having a portion axially insertable into said second end of said cup to a connected position, said fuel injector portion having a radially inwardly recessed channel on opposed sides of said base portion, said recessed channels registering with said slots in both said first and second portions of said cup when said fuel injector is in said connected position, a U-shaped clip insertable into said slots in both said first and second portions of said cup and said fuel injector channels when said fuel injector is in said connected position to lock said fuel injector and said cup together against axial movement.

2. The invention as defined in claim 1 wherein said clip is dimensioned to compressibly engage said fuel injector.

3. The invention as defined in claim 1 wherein said cup includes a section separating said cup slots, said clip having a notch dimensioned to slidably receive said section.

4. The invention as defined in claim 3 wherein said clip includes a pair of spaced apart and parallel side legs and a base extending between and connecting one end of each leg together, and wherein said notch is formed in said base,

5. The invention as defined in claim 1 wherein said clip is made of metal.

6. The invention as defined in claim 1 and comprising at least one fluid seal disposed between an outer surface of said injector portion and an inner surface of said cup.

7. The invention as defined in claim 1 wherein said fuel injector includes a laterally outwardly extending connector and wherein said cup includes a notch at said second end of said cup dimensioned to receive said connector when said injector is moved to said connected position.

8. The invention as defined in claim 1 wherein said cup is tubular and cylindrical in shape.

9. The invention as defined in claim 1 wherein said cup is fixedly secured to said fuel rail.

* * * * *